US008808035B2

(12) United States Patent
Wu et al.

(10) Patent No.: US 8,808,035 B2
(45) Date of Patent: Aug. 19, 2014

(54) WATERPROOF AUDIO JACK CONNECTOR

(71) Applicants: Feng-Hui Wu, Shenzhen (CN); Wei-De Zhang, Shenzhen (CN)

(72) Inventors: Feng-Hui Wu, Shenzhen (CN); Wei-De Zhang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 18 days.

(21) Appl. No.: 13/741,322

(22) Filed: Jan. 14, 2013

(65) Prior Publication Data

US 2013/0183867 A1 Jul. 18, 2013

(30) Foreign Application Priority Data

Jan. 13, 2012 (CN) ..... 2012 1 0009732

(51) Int. Cl.
*H01R 24/04* (2006.01)

(52) U.S. Cl.
USPC ..... 439/668; 439/944

(58) Field of Classification Search
USPC ..... 439/668, 669, 188, 944
See application file for complete search history.

(56) References Cited

U.S. PATENT DOCUMENTS 6,575,793 B1 6/2003 Honhai
7,094,088 B2 * 8/2006 Wang et al. ..... 439/188
7,198,504 B2 * 4/2007 Chien et al. ..... 439/385
7,785,119 B1 * 8/2010 Chiang ..... 439/188
7,922,542 B1 * 4/2011 Shu et al. ..... 439/668
2012/0315779 A1 12/2012 Yudate et al.

FOREIGN PATENT DOCUMENTS

TW I248240 1/2006
TW M323139 12/2007
TW I358224 2/2012

* cited by examiner

*Primary Examiner* — Hien Vu

(74) *Attorney, Agent, or Firm* — Wei Te Chung; Ming Chieh Chang

(57) ABSTRACT

An audio jack connector (100) includes an insulating housing (1) and a number of contacts (2) assembled in the insulating housing. The insulating housing defines a mating surface (111) with an insertion hole (14) through which an audio plug is inserted into a receiving channel (15) of the insulating housing, a rear surface (123) opposite to the mating surface, a mounting surface (121) facing to a printed circuit board, and a top surface (122) opposite to the mounting surface. The audio jack connector includes an insulative plate (4) attached to the rear surface of the insulating housing and a solidified glue portion (5) formed between the insulative plate and the insulating housing. The insulative plate defines a plurality of holes (41) through which the contacts extending out of the insulating housing. The rear surface of the insulating housing is sealed by the insulative plate and the solidificated glue portion.

10 Claims, 6 Drawing Sheets

WATERPROOF AUDIO JACK CONNECTOR

BACKGROUND OF THE INVENTION

1. Field of the Invention

The present invention relates generally to an audio jack connector, and more particularly to a waterproof audio jack connector securely fixed to a printed circuit board.

2. Description of Related Arts

An earphone is used for connecting with a mobile phone, a MP3 player and etc for helping users to hear sound from the mobile phone, the MP3 player and etc. An audio jack connector, into which the earphone is inserted, is widely arranged in the mobile phone, the MP3 player and etc. The audio jack connector comprises an insulating housing and a plurality of contacts retained in the insulating housing. The insulating housing defines a receiving channel for receiving an audio plug of the earphone and a plurality of terminal passageways for retaining the contacts. The insulating housing defines a mounting surface facing to a printed circuit board, a top surface opposite to the mounting surface, a mating surface through which the audio plug is inserted, and a rear face opposite to the mating surface. Each contact comprises a contacting portion extending into the receiving channel and a soldering portion extending below the mounting face for connecting with the printed circuit board. Because the soldering portions extend downward and through the mounting face, the mounting face need to define a plurality of slits through which the soldering portions extend. Therefore, the audio jack connector is not waterproofed for there is no special treatment on the mounting surface.

An audio jack connector that can be securely fixed to a printed circuit board and effectively prevent water from entering is desired.

SUMMARY OF THE INVENTION

Accordingly, an object of the present invention is to provide an audio jack connector securely fixed to a printed circuit board and effectively preventing water from entering.

To achieve the above object, an audio jack connector includes an insulating housing and a number of contacts assembled in the insulating housing. The insulating housing defines a mating surface with an insertion hole through which an audio plug is inserted into a receiving channel of the insulating housing, a rear surface opposite to the mating surface, a mounting surface facing to a printed circuit board, and a top surface opposite to the mounting surface. The audio jack connector includes an insulative plate attached to the rear surface of the insulating housing and a solidificated glue portion formed between the insulative plate and the insulating housing. The insulative plate defines a plurality of holes through which the contacts extending out of the insulating housing. The rear surface of the insulating housing is sealed because of the insulative plate and the solidificated glue portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
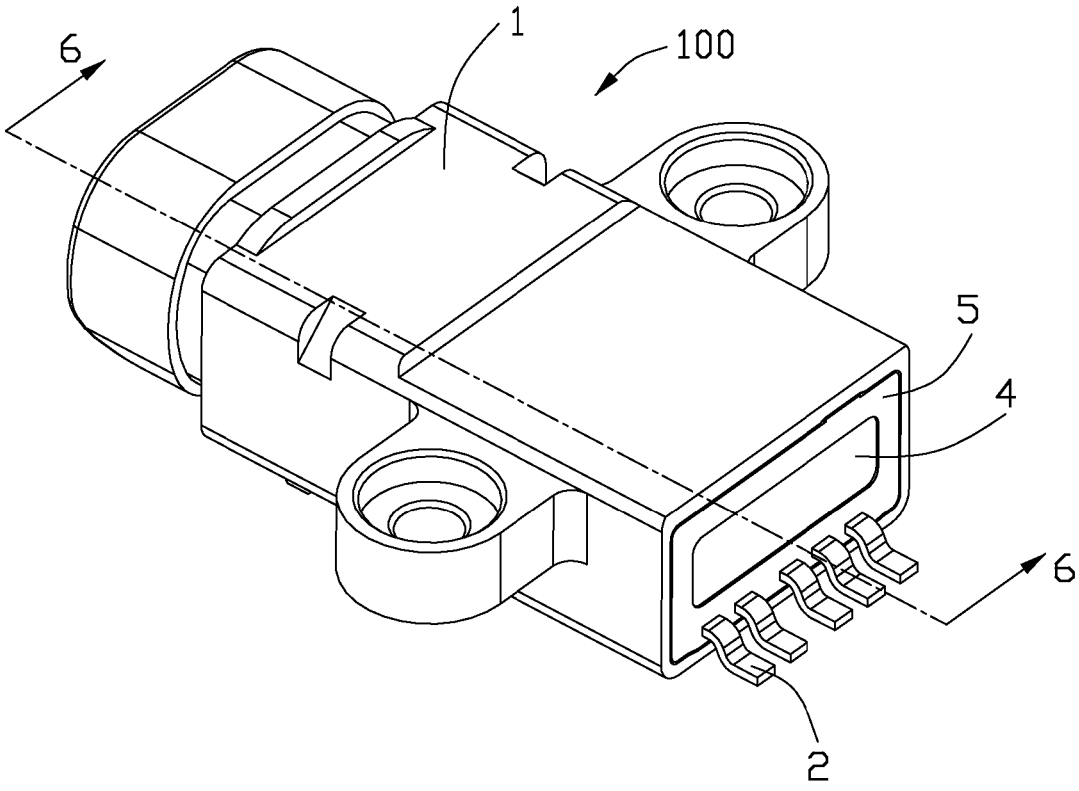
FIG. 1 is a perspective, assembled view of an audio jack connector of the present invention.

Reference will now be made in detail to the preferred embodiment of the present invention.

Referring to FIGS. 1 to 6, an audio jack connector 100 of the present invention comprises an insulating housing 1, a plurality of electrical contacts 2 retained in the insulating housing 1, a pair of board locks 3 assembled to a lower face of the insulating housing 1 for fixing the insulating housing 1 on a printed circuit board (not shown), and an insulative plate 4 attached to a rear face of the insulating housing 1. The nouns of locality "lower face, rear face" are not meant to be limiting but are descriptive of depiction according to the claims.

Figure 2:
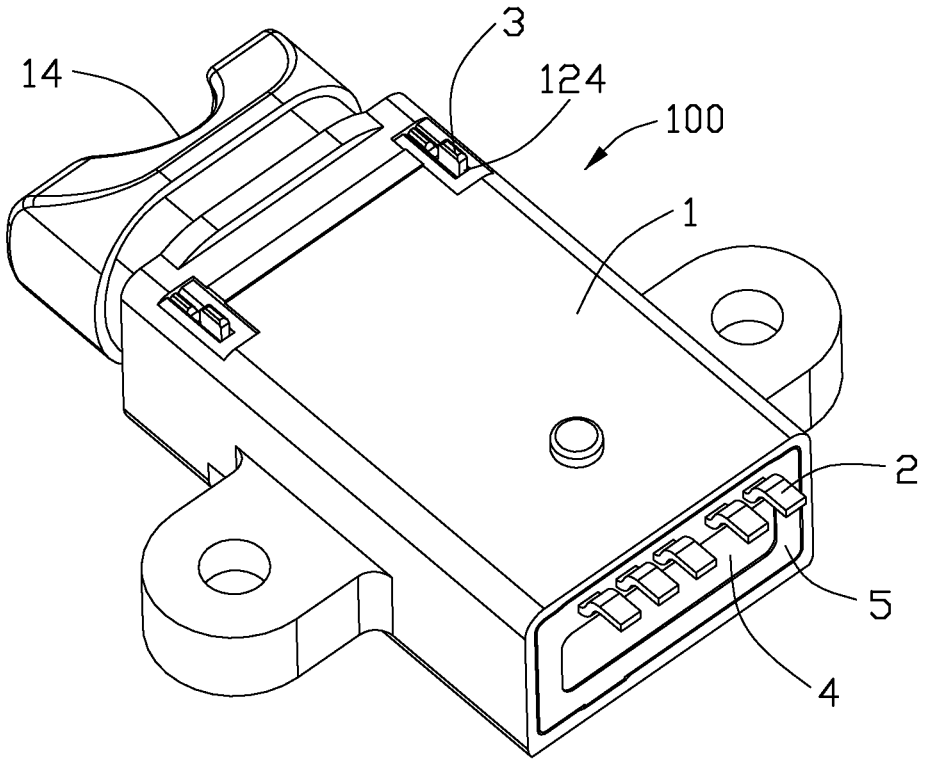
FIG. 2 is another perspective, assembled view of the audio jack connector but taken a different view with respect to FIG. 1.
Figure 3:
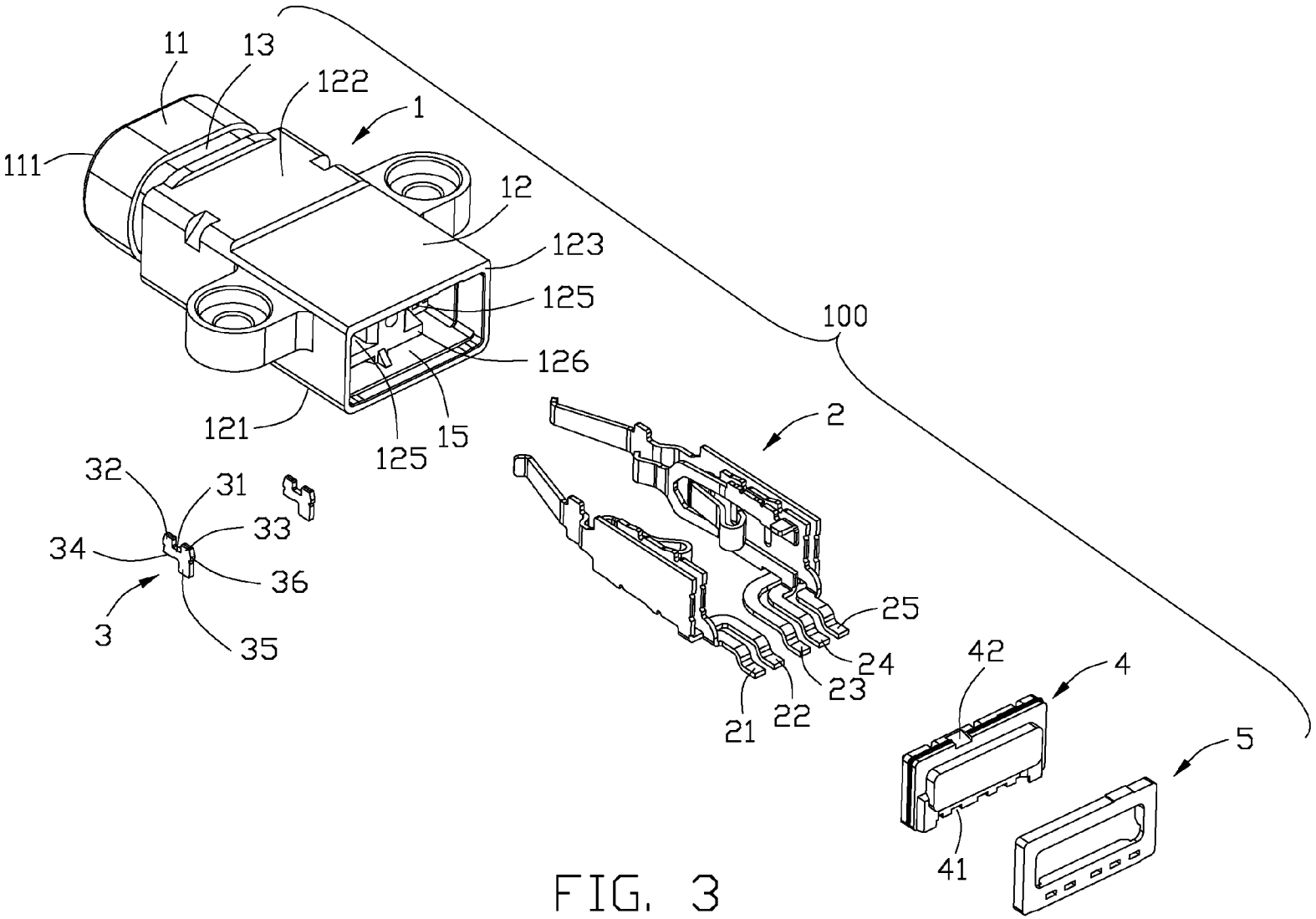
FIG. 3 is a perspective, exploded view of the audio jack connector.
Figure 5:
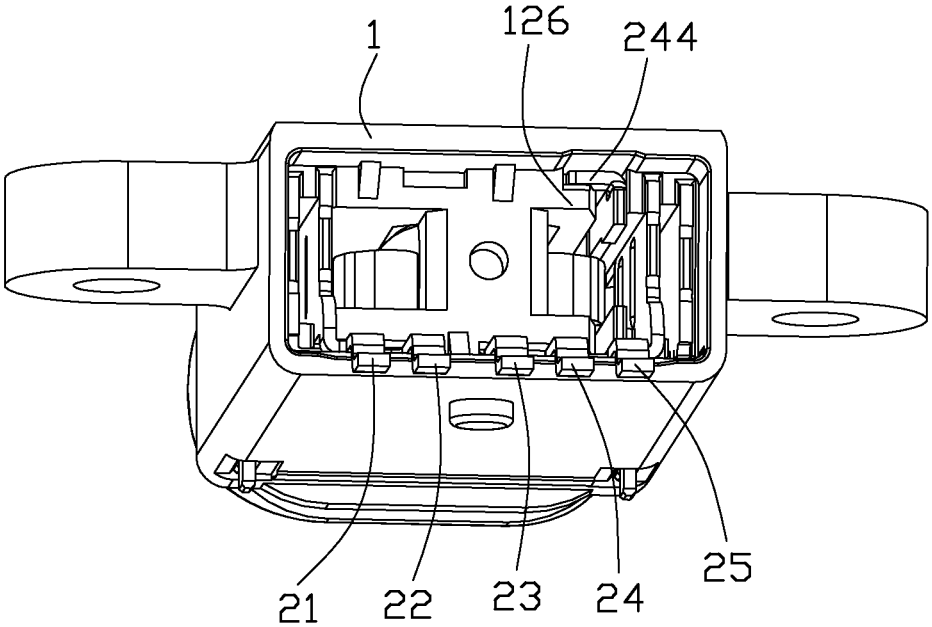
FIG. 5 is a rear face view of the electrical contacts assembled in the insulating housing.

Referring to FIGS. 2, 3, and 5, the insulating housing 1 comprises a head portion 11, a base portion 12, and a neck portion 13 connecting between the head portion 11 and the base portion 12. The head portion 11 defines a front surface 111 and an insertion hole 14 on the front surface 111. The insulating housing 1 defines a receiving channel 15 perforative through the head portion 11, the base portion 12, and the neck portion 13 for receiving an audio plug (not shown) of an earphone (not shown) through the insertion hole 14. The base portion 12 defines a mounting surface 121, a top surface 122 opposite to the mounting surface 121, and a rear surface 123 opposite to the front surface 111. The base portion 12 defines a pair of slits 124 adjacent to the neck portion 13 for receiving the board locks 3. The slits 124 are communited with outerior on the mounting surface 121. The base portion 12 defines a plurality of passageways 125 beside the receiving channel 15 and the electrical contacts 2 are retained in the passageways 125. The base portion 12 forms a protruding portion 126 beside one of the passageways 125.

Figure 4:
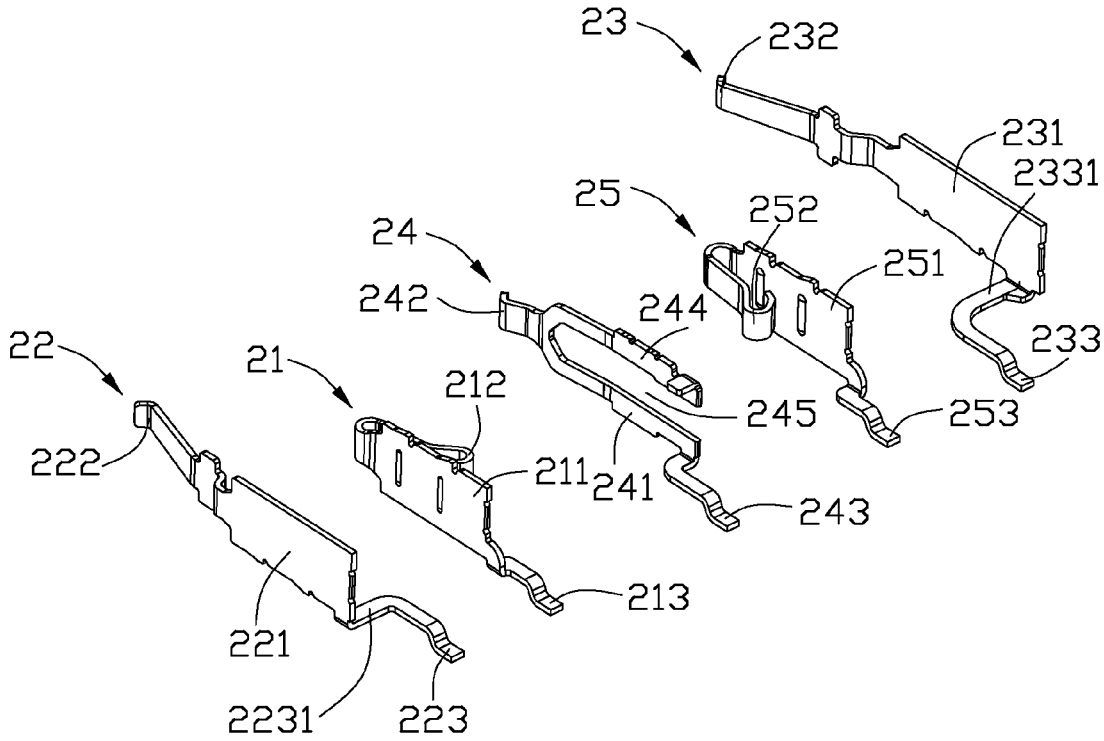
FIG. 4 is a perspective, exploded view of the electrical contacts.

Referring to FIGS. 1, 3, and 4, the electrical contacts 2 are inserted into the insulating housing 1 from the rear surface 123. Each electrical contact 2 comprises a remaining portion retained in the insulating housing 1, a contacting portion extending into the receiving channel 15 for connecting with the audio plug, and a soldering portion extending out of the insulating housing 1 for soldering on the printed circuit board. The electrical contacts 2 comprise a first contact 21 & a second contact 22 both at a first side of the receiving channel 15, and a third contact 23 & a fourth contact 24 & a fifth contact 25 all of the three at a second side of the receiving channel 15 which faces to the first side of the receiving channel 15. The first contact 21, the third contact 23, and the fourth contact 24 are used for transmitting audio signals. The second contact 22 is used for grounding. The fifth contact 25 is used for detecting whether the audio plug is fully inserted or not.

Referring to FIGS. 3 and 4, the first contact 21 comprises a first retaining portion 211, a first contacting portion 212 extending forwardly from the first retaining portion 211 and then conversedly extending backwardly into the receiving channel 15, and a first soldering portion 213 bending rightwardly and then extending backwardly from the first retaining portion 211. The second contact 22 comprises a second retaining portion 221, a second contacting portion 222 extending forwardly from the second retaining portion 221, and a second soldering portion 223 bending rightwardly and then extending backwardly from the second retaining portion 221 to be side by side with respect to the first soldering portion 213. The second soldering portion 223 has a first conjection portion 2231 going across the first retaining portion 211 from below the first retaining portion 211. Therefore, the first contact 21 and the second contact 22 are staggered in a vertical direction which is perpendicular to a mating direction along which the audio plug is inserted.

Referring to FIGS. 2-5, the third contact 23 comprises a third retaining portion 231, a third contacting portion 232 extending forwardly from the third retaining portion 231, and a third soldering portion 233 bending leftwardly and then extending backwardly from the third retaining portion 231. The fourth contact 24 comprises a fourth contacting portion 242, a fourth retaining portion 241 and a supporting portion 244 forkedly and backwardly extending from the fourth contacting portion 242, and a fourth soldering portion 243 bending leftwardly and then extending backwardly from the fourth retaining portion 241. The supporting portion 244 is engaged with the protruding portion 261 of the insulating housing 2 for preventing the fourth contact 24 from deflecting away because of its gravity. The fourth retaining portion 241 and the supporting portion 244 defines an cavity 245 therebetween. The fifth contact 25 comprises a fifth retaining portion 251, a fifth contacting portion 252 extending fowardly and then conversedly extending backwardly into the receiving channel 15 via the cavity 245, and a fifth soldering portion 253 bending leftwardly and then extending backwardly from the fifth retaining portion 251. The third soldering portion 233 has a second conjection portion 2331 going across the fourth retaining portion 241 and the fifth retaining portion 251 from below the fourth retaining portion 241 and the fifth retaining portion 251. Therefore, the third contact 23, the fourth contact 24, and the fifth contact 25 are staggered, too.

Take a panoramic view of the present invention, in a left-and-right direction which is perpendicular to both the mating direction and the vertical direction, the first soldering portion 213, the second soldering portion 223, the third soldering portion 233, the fourth soldering portion 243, and the fifth soldering portion 253 are arranged in turn, but the second retaining portion 221, the first retaining portion 211, the fourth retaining portion 241, the fifth retaining portion 251, and the third retaining portion 231 are arranged in turn. The first, second, third, fourth, and fifth contacting portion 212, 222, 232, 242, 252 are lied in the vertical plane and the first, second, third, fourth, fifth soldering portion 213, 223, 233, 243, 253 are lied in the level plane which is perpendicular to the vertical plane. The first contacting portion 212 and the fifth contacting portion 252 are farthest away from the insertion hole 14, the fourth contacting portion 242 is nearer to the insertion hole 14 than the first contacting portion 212 and the fifth contacting portion 252, the second contacting portion 222 is nearer to the insertion hole 14 than the fourth contacting portion 242, and the third contacting portion 232 is the nearest of all to the insertion hole 14. Therefore, it is well-known to persons skilled in the art that the audio plug has fourth contacting parts separated away from each other by three insulative parts, and the fourth contacting parts respectively contact with the first and the fifth contacting portions 212, 252, the fourth contacting portion 242, the second contacting portion 222, and the third contacting portion 232 for signal transmission.

Figure 6:
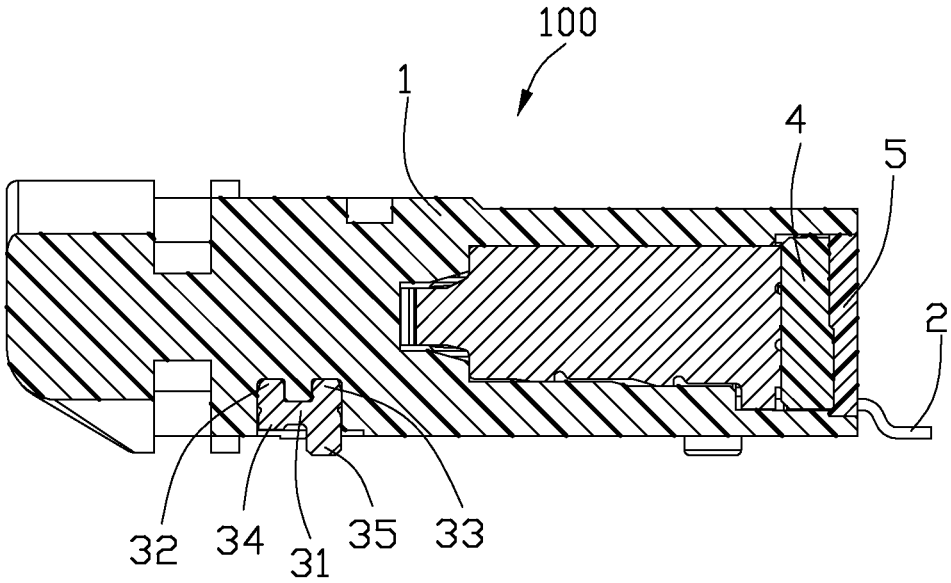
FIG. 6 is a left side view of the audio jack connector.

Referring to FIGS. 2, 3, and 6, each board lock 3 is substantially "H" shaped. The board lock 3 has a transverse arm 31, a first retaining arm 32 and a second retaining arm 33 respectively and upwardly extending from two distantal ends of an upper edge of the transverse arm 31, a shorter end portion 34 extending a small distance and a longer end portion 35 extending a large distance respectively from a lower edge of the transverse arm 31. The shorter end portion 34 is formed by breaking off the material strip. The longer end portion 35 is used for retaining on the printed circuit board. The shorter end portion 34 and the longer end portion 35 are formed at two distantal ends of the transverse arm 31 for decreasing width of the strip and accordingly, saving material. The first retaining arm 31 and the second retaining arm 32 form steps with respect to the transverse arm 31 for more fixedly retaining in the insulating housing 1.

Referring to FIG. 3, the insulative plate 4 is attached to the rear face of the insulating housing 1. The insulative plate 4 is sealed with the insulating housing 1 for waterproof purpose. In a preferred embodiment, the insulative plate 4 defines at least one cutout 42 and glue is filled between the insulative plate 4 and the insulating housing 1 via the at least one cutout 42. The at least one cutout 42 is wedge-shaped. When glue is solidified, the solidified glue portion 5 provides a pressing force to the insulative plate 4 for preventing the insulative plate 4 from disentaging away from the insulating housing 1. The insulative plate 4 defines a plurality of holes 41 through which the first, second, third, fourth, and fifth soldering portions 213, 223, 233, 243, 253 extend out of the insulating housing 1 for soldering on the printed circuit board. Glue is filled in the holes 41 after the first, second, third, fourth, and fifth soldering portions 213, 223, 233, 243, 253 extend out of the insulating housing 1 for waterproof purpose.

In the audio jack connector 100 of the present invention, because the insulative plate 4 is attached to the rear face of the insulating housing 1, it facilitates filling glue between the insulative plate 4 and the insulating housing 1 after the audio jack connector 100 is assembled on the printed circuit board. The audio jack connector 100 has a perfect waterproof effect.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An audio jack connector for mounting to a printed circuit board, comprising:

an insulating housing defining board locks, a receiving channel, a mating surface with an insertion hole for insertion of an audio plug into the receiving channel, a rear surface opposite to the mating surface, a mounting surface facing to the printed circuit board, a top surface opposite to the mounting surface, and a plurality of passageways;

a plurality of contacts assembled in the passageways of the insulating housing; and an insulative plate attached to the rear surface of the insulating housing, the insulative plate having a plurality of holes through which the contact soldering portions extend out of the insulating housing; and a solidified glue portion disposed between the insulative plate and the insulating housing;

wherein the rear surface of the insulating housing is sealed by the insulative plate and the solidified glue portion;

wherein the insulative plate defines at least one cutout and glue is filled between the insulative plate and the insulating housing via the at least one cutout;

wherein the contacts comprises a first contact & a second contact both at a first side of the receiving channel, and the first contact and the second contact are staggered in a vertical direction; and wherein each of the first contact and the second contact comprises a retaining portion retained in the insulating housing, a contacting portion extending into the receiving channel, and a soldering portion extending out of the insulating housing from the rear face, and the second contact has a first conjunction portion going across the retaining portion of the first contact from below the retaining portion of the first contact.

2. The audio jack connector as claimed in claim 1, wherein the at least one cutout is wedge-shaped.

3. The audio jack connector as claimed in claim 1, wherein the contacts comprises a third contact & a fourth contact & a fifth contact all of the three at a second side of the receiving channel which faces to the first side of the receiving channel, and wherein the third contact, the fourth contact, and the fifth contact are staggered.

4. The audio jack connector as claimed in claim 3, wherein each of the third contact, the fourth contact, and the fifth contact comprises a retaining portion retained in the insulating housing, a contacting portion extending into the receiving channel, and a soldering portion extending out of the insulating housing from the rear face, and the third contact has a second conjection portion going across the retaining portions of the fourth contact and the fifth contact from below the retaining portions of the fourth contact and the fifth contact.

5. The audio jack connector as claimed in claim 4, wherein the fourth contact comprises a supporting portion forked with the retaining portion thereof, a cavity is defined between the supporting portion and the retaining portion of the fourth contact, and the contacting portion of the fifth contact extends into the receiving channel via the cavity.

6. The audio jack connector as claimed in claim 5, wherein the insulating housing forms a protruding portion beside one of the passageways, and the supporting portion is engaged with the protruding portion.

7. The audio jack connector as claimed in claim 4, wherein all of the soldering portions of the contacts are arranged in a side-by-side position.

8. The audio jack connector as claimed in claim 4, wherein the first contact, the third contact, and the fourth contact are used for transmitting audio signals, the second contact is used for grounding, and the fifth contact is used for detecting whether the audio plug is fully inserted or not.

9. The audio jack connector as claimed in claim 8, wherein the contacting portions of the first contact and the fifth contact are farthest, the contacting portion of the fourth contact is nearer than those of the first contact and the fifth contact, the contacting portion of the second contact is nearer than that of the fourth contact, and the contacting portion of the third contact is the nearest of all, with respect to the insertion hole.

10. An electrical connector comprising:

an insulative housing defining board locks, a center mating port and a plurality of contact receiving passageways both extending along a front-to-back direction while communicating with each other in a transverse direction perpendicular to said front-to-back direction;

a plurality of contacts disposed in the corresponding contact receiving passageway, respectively, all of said contacts and said housing being configured to allow all said contacts to be only forwardly inserted into the corresponding contact receiving passageways via a rear face of the housing in said front-to-back direction;

an insulative plate having a plurality of holes and assembled to a rear side of the housing to shield the corresponding contact receiving passageways and contacts except a solder tail of each of said contacts extended out from the holes wherein the housing defines a frame structure to receive snugly circumferentially receive a contour of said insulative plate with tiny gap therebetween; and a glue portion located behind the insulative plate;

wherein said glue portion extends along an inner surface of said frame structure to seal said gap;

wherein the insulative plate includes a protrusion on a rear surface to cooperate with said frame structure to transversely sandwich the glue portion therebetween;

wherein said glue portion is of a frame configuration to surround said protrusion; and wherein the contact receiving passageways located on a same lateral side of the mating port, transversely communicate with each other.

* * * * *